US005135362A

United States Patent [19]

Martin

[11] Patent Number: 5,135,362

[45] Date of Patent: Aug. 4, 1992

[54] HYDRAULIC AXIAL PISTON PUMP

[76] Inventor: Francis J. Martin, 5 Skyline Dr., Huntington, N.Y. 11743

[21] Appl. No.: 510,021

[22] Filed: Apr. 17, 1990

[51] Int. Cl.[5] ..... F04B 1/30; F04B 21/02

[52] U.S. Cl. ..... 417/222 R; 417/218

[58] Field of Search ..... 417/269, 222, 212, 218

[56] References Cited

U.S. PATENT DOCUMENTS

| | | | |
|---|---|---|---|
| 815,911 | 3/1906 | Eddy . | |
| 2,138,194 | 11/1938 | Pfauser | 417/269 |
| 2,619,041 | 11/1952 | Born . | |
| 2,737,899 | 3/1956 | Bonnette et al. . | |
| 2,913,911 | 11/1959 | Gilkey . | |
| 2,915,985 | 12/1959 | Budzich . | |
| 2,929,371 | 3/1960 | Rank | 417/212 |
| 2,940,323 | 5/1960 | Cousins | 417/269 |
| 3,018,737 | 1/1962 | Cook | 417/269 |
| 3,077,118 | 2/1963 | Robbins . | |
| 3,304,886 | 2/1967 | Roberts | 417/222 |
| 4,007,663 | 2/1977 | Nagatomo et al. . | |
| 4,102,607 | 7/1978 | Benson | 417/222 |
| 4,520,712 | 6/1985 | Hovorka et al. . | |
| 4,642,032 | 2/1987 | McBeth | 417/269 |
| 4,690,036 | 9/1987 | Kosaka | 417/222 |
| 4,813,852 | 3/1989 | Ikeda et al. . | |
| 4,867,650 | 9/1989 | Ikeda et al. . | |

OTHER PUBLICATIONS

Public Use: Aircraft Axial Piston Pump. Ex. A.

Public Use: Commercial Checkball Pump. Ex. B.

*Primary Examiner*—Richard A. Bertsch

*Assistant Examiner*—Peter Korytnyk

*Attorney, Agent, or Firm*—William D. Hall

[57] ABSTRACT

A hydraulic axial piston pump has a rotating cylindrical barrel which defines pumping chambers and pistons reciprocating in the pumping chambers. A swash plate controls the length of travel of the pistons. During a part of each rotation of the barrel a piston will draw fluid into its complementary pumping chamber and during another part of each such rotation the piston will force fluid under pressure out of its complementary pumping chamber. Each chamber has an inlet valve which is closed when the pressure in the chamber exceeds the inlet pressure. Each chamber also has an outlet valve which is closed when the pressure in the outlet exitway exceeds the pressure in the chamber. High pressure fluid from the chambers is fed to shoes that ride on the swash plate to provide a fluid cushion between the shoes and the swash plate thus reducing friction.

27 Claims, 2 Drawing Sheets

FIG. 2
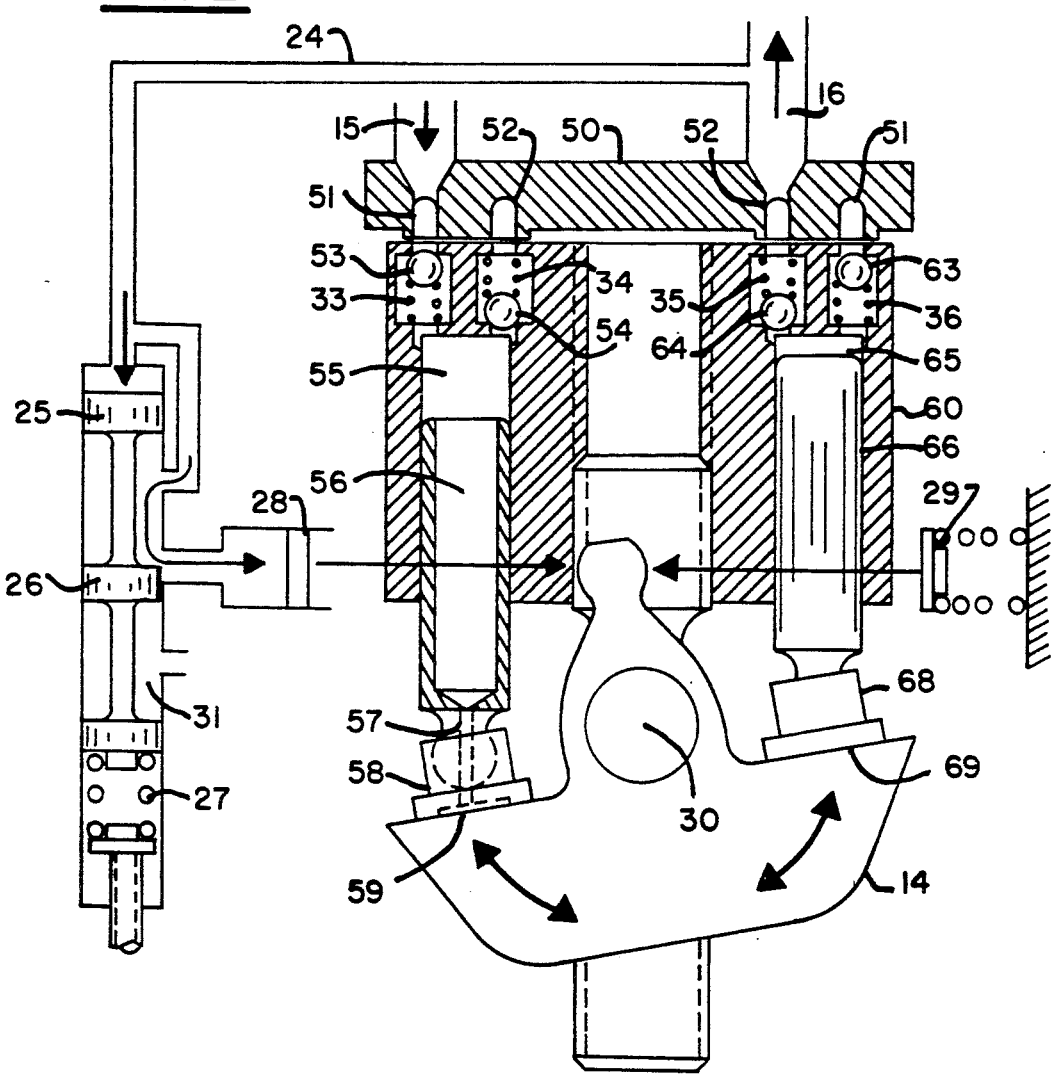
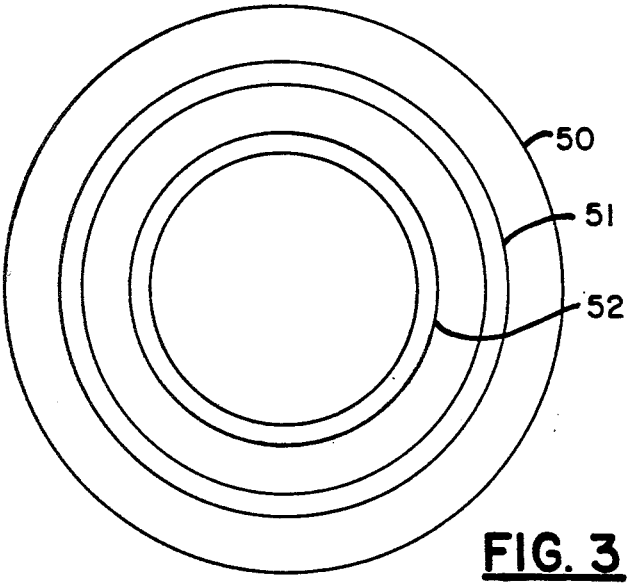
FIG. 3
FIG. 4
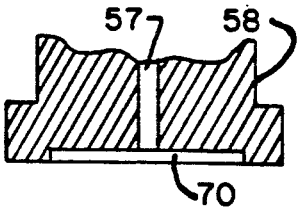

HYDRAULIC AXIAL PISTON PUMP

BACKGROUND OF THE INVENTION

This invention relates to hydraulic axial piston pumps used to convert low pressure fluid to high pressure fluid. Such pumps use a plurality of pistons driven in axial reciprocation inside a cylinder barrel by a controlled variable angle swash plate. Under flow restricted inlet operating conditions, pumps of this type will cavitate causing noise, internal pump damage and early failure. Prior methods to prevent this phenomenon have only been partially successful, and at the expense of lower pump operating efficiency.

However, a different class of piston pumps, using slidable pistons inside a non-rotating body, incorporate check valves to separate the pumping chamber from the inlet and outlet. These pumps prevent the cavitation that has caused early pump failures. One major disadvantage of this class of pump is that the delivery rate can not be easily varied. Moreover, the control mechanism is elaborate, costly, and does not have a fast enough response time constant. Moreover, the pump is not inherently stable for operation in high-speed, high-performance, pump control systems such as for aircraft or missiles.

SUMMARY OF THE INVENTION

This invention provides a fluid pressure energy translating device so constructed that objectionable noises and fluid cavitation in the pump are eliminated without reducing the pump efficiency. At the same time the pump delivery rate can be easily controlled by the variable inclination of a swash plate.

This invention also provides a fluid pressure energy translating device controlled by a variable inclination swash plate that prevents the piston pumping chamber from opening to either the inlet or outlet ports except by a pressure difference across one-way flow devices. The pumping chambers will not be open to the outlet port until the chamber pressure exceeds the outlet pressure. Also, the pumping chamber will not be open to the inlet port until the chamber pressure is less than the inlet pressure. All means used to effect the one-way flow devices shall be incorporated in the rotating cylinder barrel (including the piston assemblies) with the pump delivery controlled by a variable angle swash plate.

This invention also permits the elimination of mechanisms whereby the pumping chamber fluid pressure is gradually and moderately changed by auxiliary means, such as either shaped port plates or by valves. Elimination of these devices increases the pump efficiency with less power loss.

This invention also provides grooves in the valve plate, concentrically located about the pump rotational axis, with the effective pressure force on the cylinder barrel made to balance the pressure force of the pistons under high pressure.

BRIEF DESCRIPTION OF THE DRAWINGS

FIG. 2 is a side view, also partly in section, of another form of my invention.

FIG. 3 is a bottom view of the valve plate showing the grooves that are part of the invention.

FIG. 4 is a cross-sectional view of shoe 58.

DETAILED DESCRIPTION OF THE INVENTION

Figure 1:
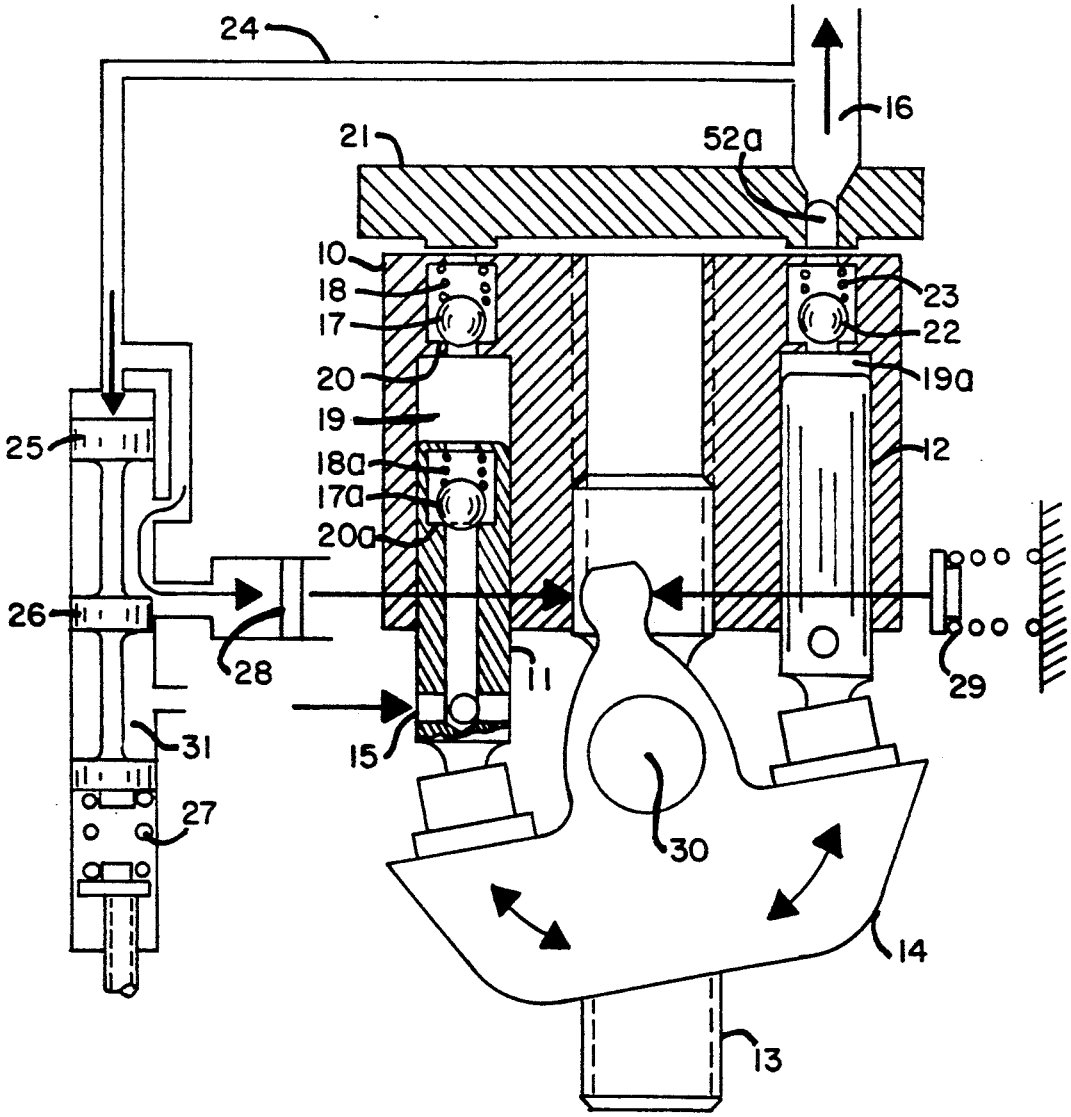
FIG. 1 is a side view, partly in section, of one form of my new pump.

FIG. 1 shows an axial piston pump with a body member preferably in the form of rotating cylindrical barrel 10, preferably incorporating multiple pistons 11 and 12. Any number of pistons may be used. The pistons 11, 12 reciprocate axially, due to swash plate 14, as the cylinder 10 rotates. The cylinder 10 is rotated by a shaft 13. The amount of axial movement of the pistons is determined by the angle of swash plate 14. The fluid to be pumped, whether a gas or a liquid, enters inlet 15 and is discharged under high pressure at outlet 16. The aforesaid pump incorporates controls with short response time, low inertia of the stroke regulating members, and low damping to produce rapid response characteristics. Hence there is inherent system stability.

Above the inlet there is a checkball 17*a* biased downwardly by spring 18*a* to insure that the inlet 15 cannot allow fluid to enter the pumping chamber 19 unless the pressure in chamber 19 is less than the inlet pressure at inlet 15. When the pressure in chamber 19 is higher than the inlet pressure at inlet 15, the checkball 17*a* moves downward against the seat helped by the bias of spring 18*a* and closes the inlet port 20*a*.

The outlet port 16 is located in valve plate 21 which remains stationary while cylinder 10 rotates. The valve plate 21 incorporates an annular groove 52*a* for the outlet fluid.

At the outlet, checkball 22 operating against spring 23 insures that the pressure in the chamber 19*a*, above piston 12, is greater than the outlet pressure 16 before the checkball 22 opens.

It is understood that all of the various pistons, and the valves associated therewith, are identical to each other and that the description of each piston applies to the others. That is to say piston 11, its check balls 17, 17*a* and seats 20, 20*a* are identical to piston 12, checkball 22 and its seats 23, 23*a*. Piston 12 has all the parts of piston 11 such as inlet 15, checkball 17*a*, etc.

Let it now be assumed that cylinder 10 rotates 180° from its present position, piston 12 moves downwardly so as to receive fluid from the input 15 while piston 11 moves upward to deliver fluid under pressure to outlet 16. During the next 180 degrees of rotation piston 11 moves downwardly to allow fluid to enter chamber 19 and piston 12 moves upward to deliver fluid under pressure to outlet 16.

The angular position of swash plate 14 determines the volume of fluid delivered at outlet 16. To regulate the outlet pressure pipe 24 applies outlet pressure to the pistons 25, 26 causing them to move downwardly against the bias of spring 27, allowing outlet pressure from 16 to move piston 28 to the right against the bias of spring 29. This rocks swash plate 14 around its axis of rotation 30, reducing its angle of rotation, reducing the volume of fluid delivered to the load, and thus reducing the pressure at outlet 16. When the pressure at outlet 16 is too low the pistons 25 and 26 move upward allowing the pressure on piston 28 to decrease through passage 31 so that spring 29 can rotate the swash plate counterclockwise, increasing its angle of rotation and the volume of fluid delivered to the load, and thus increasing the pressure at outlet 16. The control system comprising parts 24 to 29 incl. and 31 is per se old and well known in the art. Other types of control systems may be used in place of the one shown.

Referring now to the preferred form of FIGS. 2 and 3, it is noted that parts with the same reference numbers as are used in FIG. 1 are similar in function. For example, the swash plate 14 and the control system 24 to 29 and 31 are the same as for FIG. 1 and operate as described in FIG. 1.

In FIGS. 2 and 3 the valve plate 50 has two annular grooves 51 and 52 for the inlet and outlet fluids respectively.

The body member preferably in the form of cylinder 60 is rotated by shaft 13 and has one or more, usually many, chambers such as 55, 65 and pistons such as 56 and 66. Inlet checkballs 53 and 63 are pressed downwardly by the fluid pressure in input groove 51 against springs 33 and 35 and allow inlet fluid to enter chambers 55 and 65 when the inlet pressure exceeds the chamber pressure. Similarly the output checkballs 54 and 64 are pressed downwardly by the fluid pressure in output groove 52 springs 34 and 36.

The input pressure exceeds the chamber pressure while chamber 55 is rotating to the angular position shown. During that period of time fluid enters chamber 55 from groove 51 through checkball 53. When, however, at the start of the pumping strokes the fluid pressure in chamber 55 exceeds that in groove 51 checkball 53 closes. As the pressure in chamber 55 increases above the output pressure in groove 52 the checkball 54 opens and allows the high pressure fluid in chamber 55 to pass into output groove 52 and thence to output 16 and to the input pipe 24 to the control system. The control system adjusts the angle of swash plate 14 to keep the output pressure fairly constant.

To reduce the very large force between shoe 58 and the top surface 59 of swash plate 14, a passageway 57 allows high pressure fluid to pass to a cavity 70 in the bottom of shoe 58 so as to hydrostatically balance the swash plate 14. This also reduces the coefficient of friction between these two surfaces from approximately 0.1 to 0.01.

As explained under the Background of the Invention of this application there are two classes of hydraulic axial piston pumps. Each class has advantages over the other. The invention described in the present application has all of the advantages and none of the disadvantages of those two classes.

The grooves 51 and 52 have a width such that the aggregate downward pressure, exerted by the fluid in the grooves, on the cylinder is about equal to the upward aggregate pressure exerted on the cylinder by the pistons.

The type of valves which are used at the inlet and outlet of the cylinders 19, 19*a*, 55 and 65, are known in the art as check valves.

I claim to have invented:

1. In a pump:

pump means, having a body member that defines a pumping chamber, and a piston movable in a given direction in said chamber, for compressing fluid, said chamber having an inlet, means for moving said body member including said chamber and said piston transverse to said given direction in a circuitous path and including means for moving said piston to draw fluid into said pumping chamber while said cylinder and piston are moving along one part of said path and for compressing any fluid in said chamber while said chamber and piston are moving along another part of said path, and inlet valve means, carried in its entirety by and movable with said body member, for closing said inlet when the pressure in said chamber exceeds the pressure at said inlet, said chamber having an outlet, said outlet having an exitway where fluid may exit said chamber, outlet valve means, carried in its entirety by and movable with said body member, for controlling the fluid flow to said outlet and for preventing fluid flow to said exitway when the fluid pressure in said exitway exceeds the fluid pressure in said chamber;

said outlet valve means comprising means for allowing fluid flow therethrough in only one direction.

2. In a pump as defined in claim 1 wherein said circuitous path is a circle.

3. In a pump as defined in claim 2:

said means for moving said piston comprising a swash plate that moves said piston relative to said chamber during the movement of said chamber and piston around said circle.

4. A pump as defined in claim 1, wherein said outlet valve means comprises a check valve.

5. A pump as defined in claim 1, wherein each of said inlet and outlet valve means comprises a check valve.

6. A pump as defined in claim 1 in which said circuitous path is a circle, and stationary means defining a groove extending along at least a part of a circle for feeding fluid to said inlet.

7. A pump as defined in claim 6 comprising a swash plate for reciprocating said piston when said cylinder moves in said path.

8. A pump as defined in claim 1 comprising means, including a swash plate, for reciprocating said piston.

9. In a pump:

a body member having an axis of rotation, means for mounting said body member for rotation about said axis, means for rotating said body member about said axis, said body member defining a chamber, a piston movable back and forth in said chamber and in directions that are parallel to said axis, means for moving said piston back and forth in said chamber during rotation of said body member, said cylinder having a fluid input and said input having a fluid entranceway, first valve means in said input for closing said input when the pressure in said chamber exceeds the pressure at said entranceway, and for allowing fluid to flow from said entranceway to said chamber when the fluid pressure at said entranceway exceeds the fluid pressure in said chamber, said cylinder having a fluid outlet, and second valve means in said outlet for closing said outlet when the pressure downstream of said outlet is greater than the pressure in said chamber, and for allowing fluid under pressure in said chamber to flow through said outlet when the fluid pressure in said chamber exceeds the fluid pressure at said outlet, said first and second valve means being carried in their entirety by and rotating with said body member, said second valve means comprising means for allowing fluid flow therethrough in only one direction.

10. The pump of claim 9 wherein said first and second valve means comprise check valves for controlling the fluid at high rates of flow without cavitation.

11. A pump as defined in claim 9 wherein said means for moving said piston includes a swash plate for reciprocating said piston when said body member rotates, a shoe connected to said piston and sliding on said swash plate for reciprocating said piston, and means for feeding fluid under pressure between said shoe and said swash plate for reducing the force of said shoe on said swash plate.

12. A pump as defined in claim 9, comprising:

said cylinder having an open end through which said piston passes and another end opposite to said open end, said first and second valve means being at said another end, a valve plate adjacent said another end, said valve plate having an input groove communicating with said input and an output groove communicating with said fluid outlet, said grooves having the shapes of concentric circles respectively and a center on said axis.

13. A pump as defined in claim 9, wherein said first valve means comprises a check valve.

14. A pump as defined in claim 9 wherein said second valve means comprises a check valve.

15. A pump as defined in claim 9 wherein each of said first and second valve means comprises a check valve.

16. A pump as defined in claim 9, comprising:

stationary means defining concentric grooves for feeding fluid to and receiving fluid from said cylinder, one of said grooves communicating with said inlet and the other groove communicating with said outlet.

17. A pump as defined in claim 16 comprising a swash plate for reciprocating said piston.

18. A pump as defined in claim 17 including means for reciprocating said piston comprising a swash plate.

19. In a pump:

pump means, having a body member defining a pumping chamber, and a piston movable in a given direction in said chamber, for compressing fluid, said chamber having an outlet, means for moving said body member including said chamber and said piston transverse to said given direction in a circuitous path and including means for moving said piston to draw fluid into said pumping chamber while said cylinder and piston are moving along one part of said path and for compressing any fluid in said chamber while said chamber and piston are moving along another part of said path, and outlet valve means carried entirely by and movable with said body member for closing said outlet when the pressure at said outlet exceeds the pressure in said chamber, said outlet valve means comprising means for allowing fluid flow therethrough in only one direction.

20. In a pump as defined in claim 19 said chamber having an inlet, said inlet having an opening through which fluid may enter said chamber, inlet valve means carried in its entirety by said body member for controlling the fluid flow to said inlet and for preventing fluid flow to said inlet when the fluid pressure in said chamber exceeds the fluid pressure at said inlet.

21. A pump as defined in claim 21 wherein said inlet valve means comprises a check valve.

22. A pump as defined in claim 20 in which each of said inlet valve means and said outlet valve means comprises a check valve, said body member having two ends, said check valves both being located adjacent one of said ends.

23. A pump as defined in claim 1, wherein said inlet valve means comprises a check valve.

24. A pump as defined in claim 19 wherein said outlet valve means comprises a check valve.

25. A pump as defined in claim 19 comprising stationary means, defining a groove that communicates with said outlet, for receiving fluid from said pump.

26. A pump as defined in claim 25 comprising means including a swash plate, for reciprocating said piston.

27. A pump as defined in claim 19 comprising swash plate means for reciprocating said piston.

* * * * *